United States Patent [19]

Dyer et al.

[11] 4,123,862

[45] Nov. 7, 1978

[54] DECORATIVE DISPLAY ASSEMBLY, KIT AND METHOD OF FABRICATING SAME

[76] Inventors: Shannon L. Dyer; Ronald L. Stangl, both of 7707 Shady Cove Ave., Sun Valley, Calif. 91504

[21] Appl. No.: 699,363

[22] Filed: Jun. 24, 1976

[51] Int. Cl.[2] ..... G09F 1/12

[52] U.S. Cl. ..... 40/152

[58] Field of Search ..... 40/124.1, 126 A, 158, 40/152, 152.1; 35/7 A, 26; 46/31; D6/232, 233, 234

[56] References Cited

U.S. PATENT DOCUMENTS

| | | | |
|---|---|---|---|
| D. 13,022 | 7/1882 | Hursen | D6/234 |
| D. 35,935 | 6/1902 | Hammack | D6/234 |
| D. 151,375 | 10/1948 | Koltnow | 40/152 X |
| 236,244 | 1/1881 | Nurre | 40/158 R |
| 2,996,832 | 8/1961 | Rubin | 46/31 X |
| 3,144,932 | 8/1964 | Zerbo | 35/26 X |
| 3,722,122 | 3/1973 | Sesto | 40/152 |
| 3,824,712 | 7/1974 | Powell | 35/26 |
| 3,879,874 | 4/1975 | Broussard | 40/152.1 |
| 3,928,921 | 12/1975 | Gurman | 35/7 A |
| 3,975,850 | 8/1976 | Giaume | 40/125 H |
| 3,998,002 | 12/1976 | Nathanson | 46/31 X |

*Primary Examiner*—Louis G. Mancene
*Assistant Examiner*—Wenceslao J. Contreras
*Attorney, Agent, or Firm*—John J. Posta, Jr.

[57] ABSTRACT

An improved decorative display assembly having the aspect of a three dimensional sculpture is provided, as well as a novel kit and the present novel method of fabricating the same. In this regard, a frame may be provided to which a first series of display sheets are separately connected in spaced relation. The sheets may be, for example, photos, prints, fluorescent cards or other sheets bearing decorative indicia on one side thereof.

The prints have been made self-supporting by attaching mounting boards to the indicia-free sides thereof. These first sheets form a first structural level for the assembly. Spacers, preferably in the form of small blocks, are then fixedly connected to marginal portions of the photo-bearing surfaces of the prints, whereupon a second series of prints are connected adjacent their margins, and via their mounting board backings to the first sheets so as to only partially overlap the first sheets and thus form a second structural level to the sculpture.

Additional series of display sheets can be similarly connected to provide additional structural level, all to ultimately form the desired three dimensional multi-level sculpture montage effect of free form or predetermined shape. The end product is a highly decorative display.

The display sheets can be coated with clear plastic or the like to render them permanently protected, whereupon the finished individualized sculpture assembly can be mounted on a table, wall or the like for display.

The kit provides the necessary materials for fabricating the assembly according to individual taste or according to patterns which can be included in the kit. The kit may include, in addition to the previously described components, such items as temporary supports to align components before they are permanently fixed in place, color coded edge margins for the prints, etc. The box in which the kit can be supplied can itself form part of the kit in that it can be used as a support frame, if desired, for the assembly. Moreover, lighting means, fluorescent cards and other decorative display means, such as screens, can be incorporated into the kit to facilitate fabrication of the desired decorative assembly.

12 Claims, 17 Drawing Figures

DECORATIVE DISPLAY ASSEMBLY, KIT AND METHOD OF FABRICATING SAME

BACKGROUND OF THE INVENTION

Field of the Invention

The present invention generally relates to display means and more particularly relates to improved decorative three dimensional sculptural display means, adaptable to permanent montages and other forms of treatment, and to kits and methods for fabricating the same.

Prior Art

There are many types of three dimensional sculptures and other decorative three dimensional representations, utilizing various types of media. However, most such media require a substantial degree of artistic skill, acquired by long practice, in order to work them to a form which will produce results which are worthy of decorative display.

Moreover, many of such media are expensive to use, and the equipment for utilizing the same are also complicated, messy and difficult to manipulate. Often, the amateur has no proper room in which to carry out such artistic work nor proper instructions or relevant techniques.

Consequently, although many persons at one time or another attempt such media of expression, few succeed. Nevertheless, there remains a well recognized human need for individual artistic expression and approval by others. This need is largely unsatisfied in most persons, because of lack of time, guidance, training, insight and selection of proper medium of expression.

Moreover, there are in many instances, real needs for decorative devices which will effectively, properly and tastefully serve as wall, table top and similar three dimensional decorations, both in the home and in the place of business. Commercially purchased decorations are usually very expensive. Moreover, it is usually very difficult to locate exactly what will satisfy the individual and make the most effective appearance for such purposes.

There is presently also a need for readily available, inexpensive means for effectively displaying the results of photographic endeavors, whether they be largely of the occasion-recording or documentary type or of the artistic rendering type, or both. Thus, photos and photo prints, when kept at all in a systemized manner, usually are merely stored in covered photo albums, or the like, and are quickly forgotten.

Often, only a few selected photos out of a large number are enlarged and of these, perhaps only one or two are mounted for individual display. The rest, many of which may be highly decorative, are put out of sight and mind. Yet they may represent substantial artistic accomplishments.

Means for more effectively and more frequently displaying such photos and the like, especially if simple and inexpensive, would be well received by the millions of camera enthusiasts. Moreover, if such display means could present a mass of carefully selected photos in a manner which could be individualized and which could also result in a highly decorative display effect for wall, desk top or the like, both of the above-described needs, that is, for photo display and decorative creation, would be satisfied.

Moreover, such display means would be even more effective if it could also easily and effectively incorporate other elements such as memorabilia in the form of medals, awards, diplomas, baby shoes, etc. so as to enhance the personal value of the display.

SUMMARY OF THE INVENTION

The foregoing needs are satisfied by the improved decorative display assembly of the invention, and the novel kit and method for fabricating the same. The assembly, kit and method are substantially as set forth in the Abstract above. They are equally adaptable for the effective decorative display of all manners and mixtures of display sheets, such as photos, colored cards, screens, etc.

Thus, a kit is provided which preferably includes base support frame members for the display sheets, a plurality of mounting boards upon which to individually mount the display sheets, a plurality of spacers to separate adjacent sheets into a plurality of levels for a three dimensional sculptural effect, and coating means, such as clear liquid plastic coating resin, for permanently coating the finished assembled display sheets. The sculpture could be made of plastic, metal, or the like.

Temporary removable supports and pattern sheets may also be provided to help accurately position the various mounted display sheets and spacers relative to the frame in building up the desired three dimensional assembly.

In accordance with the present novel method, the base frame is assembled, and the individual display sheets are mounted on and sized to the mounting boards, as by cutting or the like, with the indicia-free sides of the sheets attached to the mounting boards.

In the event that certain of the display sheets are in the form of decorative, indicia-bearing colored cards or the like, or translucent or transparent windows for associated light means, etc., those sheets are not attached to mounting boards. In any event, the display sheets, when rigid and self-supporting, are ready for attachment to the frame and to each other.

Attachment to the frame is effected, as by securing, through glue or the like, a number of the display sheets at spaced intervals to the frame, all lying in substantially the same plane, to form a first series of sheets and a first structural level to the assembly.

A number of spacers are then applied, as by adhesive, etc. to marginal portions of the indicia-bearing surfaces of the first display sheets, whereupon the margins of the indicia-free side of a second series of the rigid, self-supporting display sheets are secured, as by adhesive, to the upper surfaces of the spacers in partial overlapping relation to the first series of display sheets to form a second structural level to the assembly.

In order to assure that the proper alignment of components is met, each level of display sheets can be positioned by reference to a separate pattern sheet provided with the kit. Thus, the first pattern sheet shows the proper positioning of the frame, the first series of display sheets and the first series of spacers thereon, while the second pattern sheet shows the proper positioning of the second series of display sheets and second series of spacers thereon and provides means for checking the proper alignment of the previously applied components.

In addition, temporary supports can be temporarily applied between overlapping display sheets in adjacent levels to maintain them in proper spatial alignment while the spacers are being fixedly attached to the display sheets. Thus, level after level of display sheets in free or predetermined form can be easily built up to satisfy the need of individual expression and to provide the most effective, decorative and useful display.

When the assembly is complete, it is then preferable to coat the display sheets, beginning at the first level and working up the levels, with a clear protective settable coating so as to render the assembly permanent. This can be done by evenly applying clear plastic liquid resin to the surfaces of the display sheets, as needed, and allowing the resin to harden after all bubbles are removed from the coated surfaces, as by blowing air gently thereacross.

The finished assembly is then ready for mounting on the wall, furniture top, etc. and provides the desired distinctive decorative three-dimensional sculptured effect. Further features are set forth in the following detailed description and accompanying drawings.

DRAWINGS

DETAILED DESCRIPTION

Figure 1:
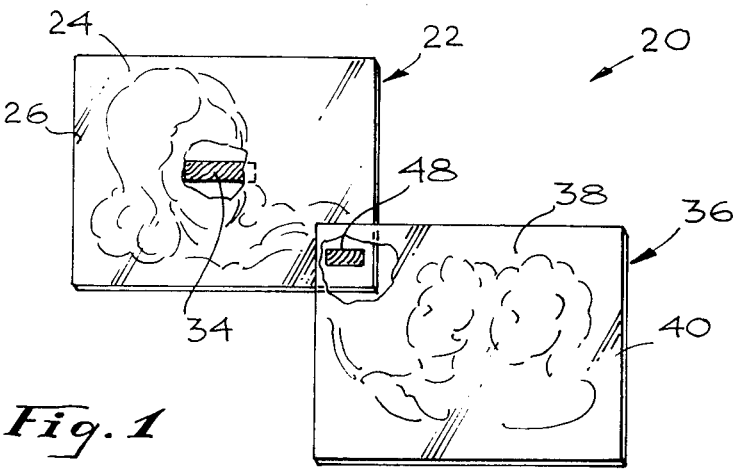
FIG. 1 is a schematic front elevation of a first preferred embodiment of the improved decorative three-dimensional display assembly of the present invention, portions being broken away to illustrate certain internal features of construction.
Figure 2:
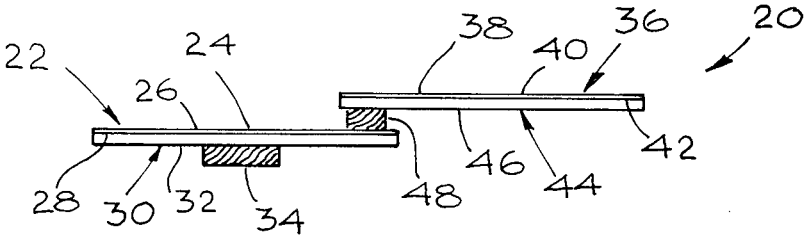
FIG. 2 is a schematic top plan view of the assembly of FIG. 1.

FIGS. 1 and 2

Now, referring more particularly to FIGS. 1 and 2, a first preferred embodiment of the improved, decorative three-dimensional display assembly of the present invention is schematically depicted therein.

Thus, assembly 20 is shown which includes a first flat display sheet 22 of extended surface area bearing indicia in the form of a photo 24 on one side 26 thereof. To the opposite indicia-free side 28 of sheet 22 is affixed as by adhesive, such as glue, a stiff mounting board 30 of paperboard, cardboard, wood, plastic, pasteboard or the like to make sheet 22 self-supporting.

Sheet 22 has been trimmed, as by cutting, to fit exactly the dimensions of board 30. The rear side 32 of board 30 is connected, in accordance with the present method, to a mounting block 34 of wood or the like and of substantial thickness, with which to attach assembly 20 to a wall, etc., while allowing it to project therefrom for a decorative three-dimensional effect.

A second display sheet 36 is attached to first display sheet 22 in partial overlapping relation to enhance the decorative three-dimensional effect of assembly 20. Thus, sheet 36 comprises a photo 38 on the indicia-bearing side 40.

To the indicia-free side 42 of sheet 36 is connected, as by glue, a flat mounting board 44 similar to board 30, and which makes sheet 36 self-supporting, and to the rear side 46 of board 44 is fixedly connected, as by glue or the like, along a margin thereof, a spacer 48, in turn fixedly connected, as by glue, etc., to a margin of photo 24 so that sheet 36 only partially overlaps sheet 22, so that sheets 22 and 36 are generally parallel to each other and so that the major portions of both photo 24 and photo 38 are clearly visible, as shown in FIG. 1, to provide the desired unique three-dimensional sculptured effect.

Accordingly, a decorative display assembly is easily provided. This assembly can be made permanent by coating photos and, desirably, the remainder of sheets 22 and 36, and boards 30 and 44 with clear settable liquid plastic resin and setting the same to a hardened state.

Such plastic resin may be, for example, an acrylic monomeric resin such as methyl methacrylate monomer readily settable in the presence of light, heat or catalysts to clear hard acrylic polymeric resin to provide the assembly with a clear hard professional finish. Other suitable coating resins such as epoxy and/or polyester resins or the like can be used, if desired.

FIG. 3

Figure 3:
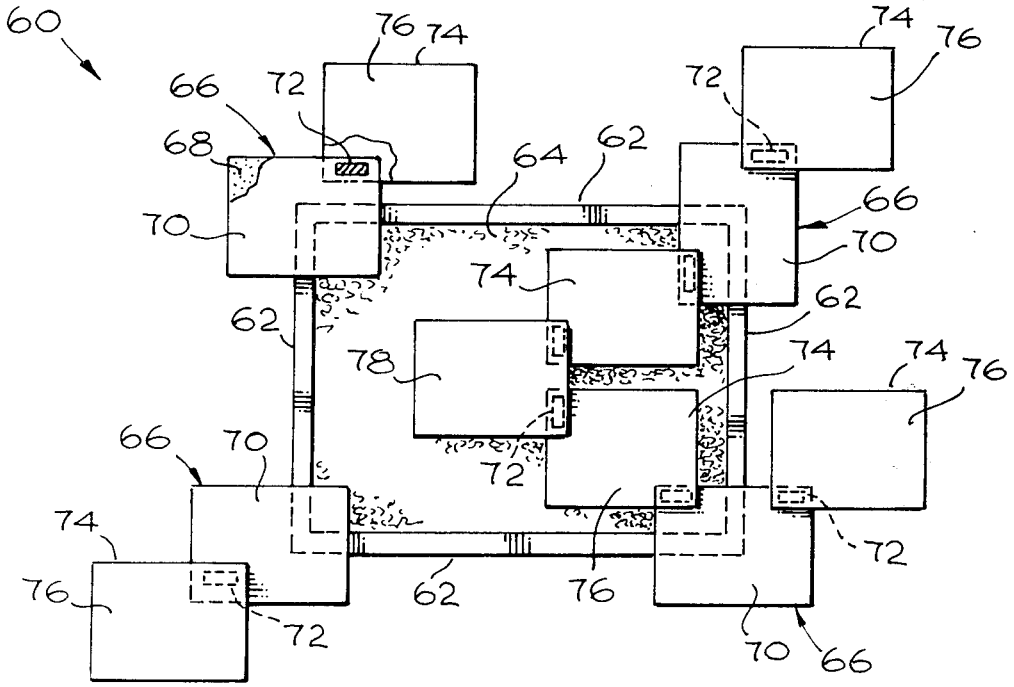
FIG. 3 is a schematic front elevation of a second preferred embodiment of the improved decorative three-dimensional display assembly of the present invention, portions thereof being shown broken away and in phantom outline to further illustrate certain internal features of construction.

A second preferred embodiment of the novel decorative assembly of the invention is schematically depicted in FIG. 3. Thus, there is shown in front elevation an improved assembly 60 comprising an open topped generally square frame 62 of strips of wood or the like with a backing 64 of wood or the like.

Secured, as by adhesive or the like, to the top of frame 62 at spaced intervals, such as at the corners thereof, as shown in FIG. 3, are a first series of generally flat self-supporting display sheets 66 of extended surface area. Sheets 66 may have mounting board backings 68 to give them the necessary rigidity. Sheets 66 have front faces 70 thereof bearing indicia such as photographs or the like (not shown).

To the front faces 70 of sheets 66 adjacent the margins thereof, are fixedly connected spacers 72, which in turn are fixedly connected to partially overlying sheets 74 forming a second series. Sheets 74 are similar to sheets 66 and are generally parallel thereto, bearing on their front faces 76 suitable indicia such as photos (not shown).

A third series of sheets 78 similar to sheets 66 and 74 can be secured, as by additional spacers 72, in overlapping relation, to sheets 74 in the manner previously described. One of such sheets 78 is shown in FIG. 3.

In such manner three or more structural levels of display sheets can be built up on frame 62 to any desired integrated pattern, with the indicia on the sheets largely visible and the overall effect highly decorative.

FIG. 4

Figure 4:
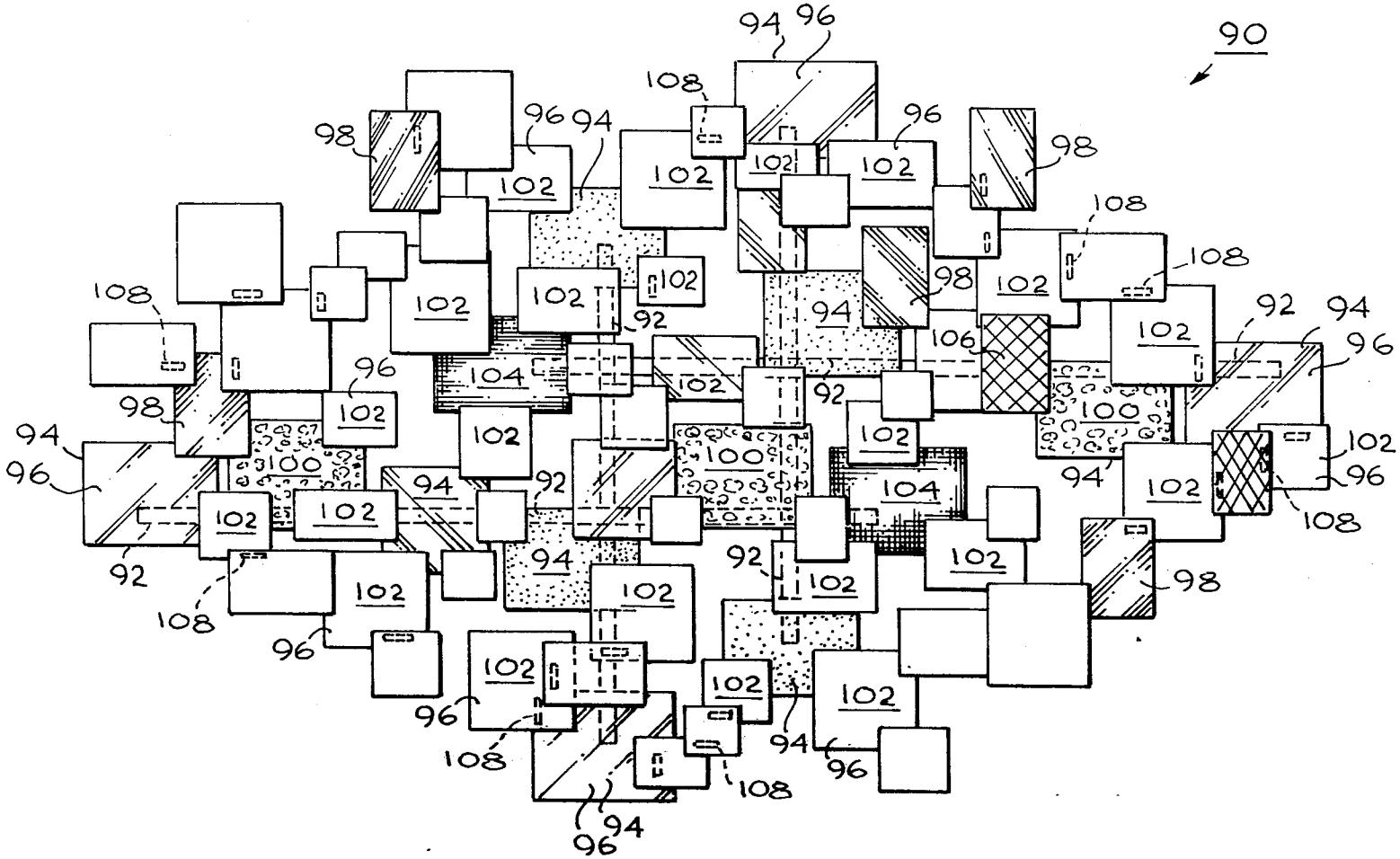
FIG. 4 is a schematic front elevation of a third preferred embodiment of the improved decorative three-dimensional display assembly of the present invention, portions being broken away and in phantom outline to illustrate certain internal features.

A further preferred embodiment of the improved decorative display assembly is depicted schematically in front elevation in FIG. 4. This embodiment utilizes, for example, a combination of photos colored and uncolored, decorative colored cards, grids, screens and lighted panels to provide a unique three-dimensional effect.

Thus, an assembly 90 is shown which comprises a plurality of elongated spaced but interconnected frame members 92 laid out in an irregular free-form somewhat grid-like pattern.

To the upper surfaces of members 92 are fixedly secured at random spaced intervals a first series of display sheets 94, most of which bear photos 96 on their front faces, some of which are colored. Sheets 94 are of extended surface area, flat and self-supporting, with or without backing sheets or the like (not shown).

Others of sheets 94 comprise colored cards 98, some of which are fluorescent, while still others are colored lighted panels 100. Sheets 94 form a first sculptured or architectural level on the three-dimensional assembly 90.

To the margins of certain of sheets 94 are connected in partial overlapping relation a second series of sheets 102 similar to sheets 94, including photos 96, colored cards 98 and lighted panels 100 on their front faces, as well as decorative screens 104, grids 106 and the like. Sheets 102 form a second structural level in assembly 90.

The manner of such connection comprises the fixed attachment, as by adhesive, of spacers 108 on the margins of selected indicia-bearing surfaces of certain sheets 94 and the fixed connection, as by adhesive, of marginal portions of certain sheets 102 to the upper surfaces of spacers 108 so as to only partly overlap sheets 94.

A more or less random pattern can be followed in selecting the sheets 94 to which to attach sheets 102 and in the positioning of photos 96, cards 98, lighted panels 100, screens 104 and grids 106 among each other as sheets 102, as well as sheets 94. Individual discretion can be maximized while accomplishing the desired decorative display purposes easily, simply and permanently.

The finished assembly 90, with or without first overlapping photos 96 with clear plastic for protection, can then be displayed on a suitable stand attached to frame 92 or can be hung from or otherwise attached to a wall, backing member, etc. for maximum effect.

FIG. 5

Figure 5:
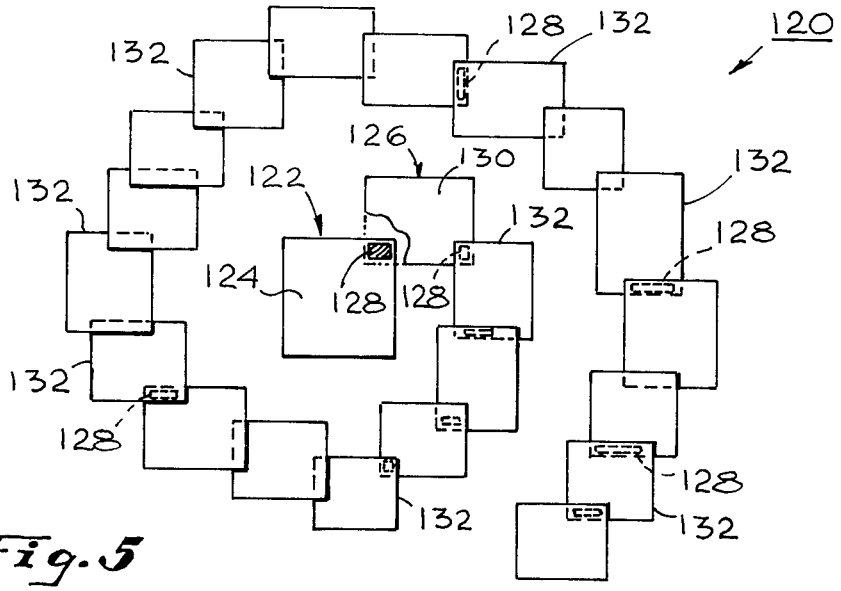
FIG. 5 is a schematic front elevation of a fourth preferred embodiment of the improved, decorative, three-dimensional display assembly of the present invention, in the form of spiral helix with a central core, depicting a family history in photos and memorabilia, portions being broken away to illustrate certain internal features.

A further embodiment of the novel three-dimensional decorative assembly is schematically depicted in front elevation in FIG. 5. Thus, a configuration suitable for the presentation of a family history in photos and memorabilia is shown for assembly 120.

There is a single large central flat self-supporting display sheet 122 bearing on its face a photo 124 such as a wedding photo, to the margin of which is fixedly connected in partial overlapping relation and by its margin a second similar sheet 126, as through a thick spacer block 128 of wood or the like. Sheet 126 bears a photo 130, such as a baby picture, on its face. Sheet 126 is parallel to and above sheet 122.

This arrangement is continued through a successive series of sheets, generally designated as sheets 132, interconnected in overlapping stepped relation at their margins through spacer blocks 128 to form a spiral helix with sheet 122 as the core.

The photos and memorabilia, such as baby bonnets, baseball awards, swimming medals, baby booties, etc. which form the indicia on the front faces of sheets 132 can provide a coherent progressive depiction of the growth and accomplishments of the family involved, with additional steps in the form of new sheets 132 added, as needed, in response to new family developments.

Figure 6:
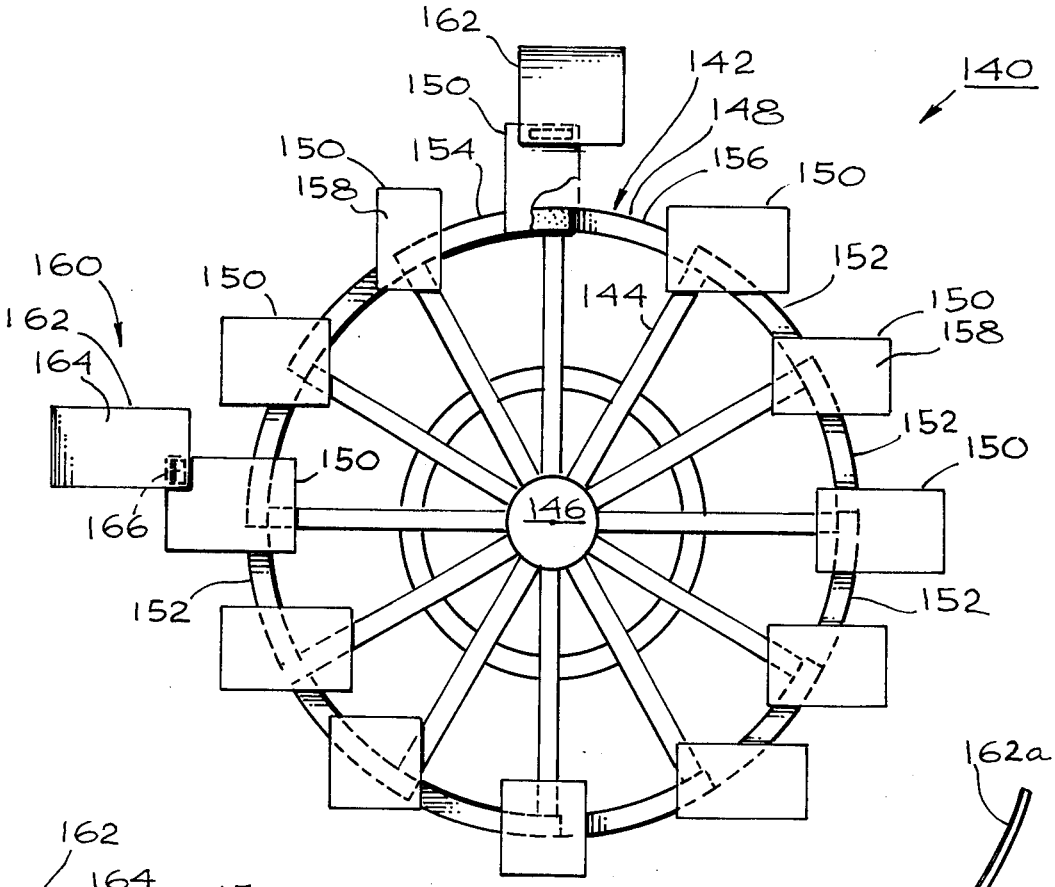
FIG. 6 is a schematic front elevation of a fifth preferred embodiment of the improved, decorative, three-dimensional display assembly of the present invention, in the form of a spiral, stepped clock, portions being broken away to illustrate certain internal features.
Figure 7:
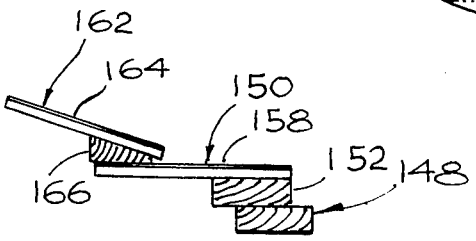
FIG. 7 is a schematic fragmentary top plan view of the clock frame and a pair of display sheets from the assembly of FIG. 6 joined in partial overlapping angled relation by an angled wedge-shaped spacer.
Figure 8:
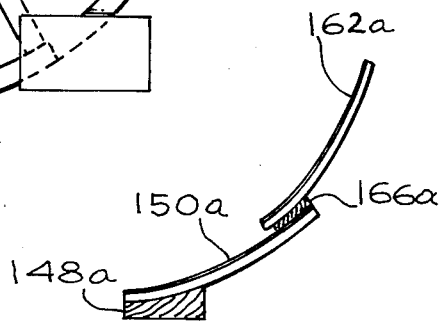
FIG. 8 is a schematic fragmentary top plan view of an alternative embodiment for the clock frame and a pair of curved display sheets joined together by a curved spacer to provide an arcuate configuration to the rim of said clock.

FIGS. 6, 7 and 8

A fifth preferred embodiment of the novel decorative assembly of the present invention is schematically depicted in front elevation in FIG. 6. Thus, an assembly 140 is shown in the form of a clock with a frame 142 of twelve spokes 144 radiating from a central core 146 and connected to an outer ring 148 to depict the positions of the hours on a clock.

It is at these positions on the top of ring 148 that twelve separate flat self-supporting display sheets 150 of extended surface area are fixedly connected, as by adhesive or the like. Open ring 148 has a plurality of steps 152 which ascend from the 1 o'clock position through the 12 o'clock position so that upper end 154 of ring 148 at 12 o'clock lies well above the beginning 156 of ring 148 which is closer to the 1 o'clock position than is end 154, as shown in FIG. 6.

The result is that each successive sheet 150 around ring 148 beginning with the 2 o'clock positioned sheet 150 is at a higher level than the next preceeding sheet 150 but at a lower level than the next preceeding sheet 150, so that ring 148 is in reality a spiral and provides assembly 140 with stepped sheets 150 for a novel three-dimensional effect.

Each sheet 150 bears on its front face 158 indicia (not shown) such as a separate photo or the like attractively displayed for easy viewing.

An additional array 160 of display sheets 162 bearing indicia (not shown) on their faces 164 and generally similar to sheets 150 can be fixedly connected to the outer margin of the faces 158 of selected sheets 150 via raised spacer blocks 166 which may be, for example, angled or slanted, if desired, as shown in FIG. 7 to angle or slant sheets 162 above sheets 150. Thus a second level of sheets is provided.

In an alternative embodiment, as shown in FIG. 8, sheets 150*a* are connected to ring 148*a* and are curved, as are spacer blocks 166*a* and sheets 162*a* connected thereto in partial overlapping relation, to impart a different decorative effect to assembly 140.

Third, fourth and additional levels of self-supporting sheets bearing photos and similar to sheets 150 and 162 can be built up peripherally around assembly 140 as desired, and as needed for the desired effects.

Figure 9:
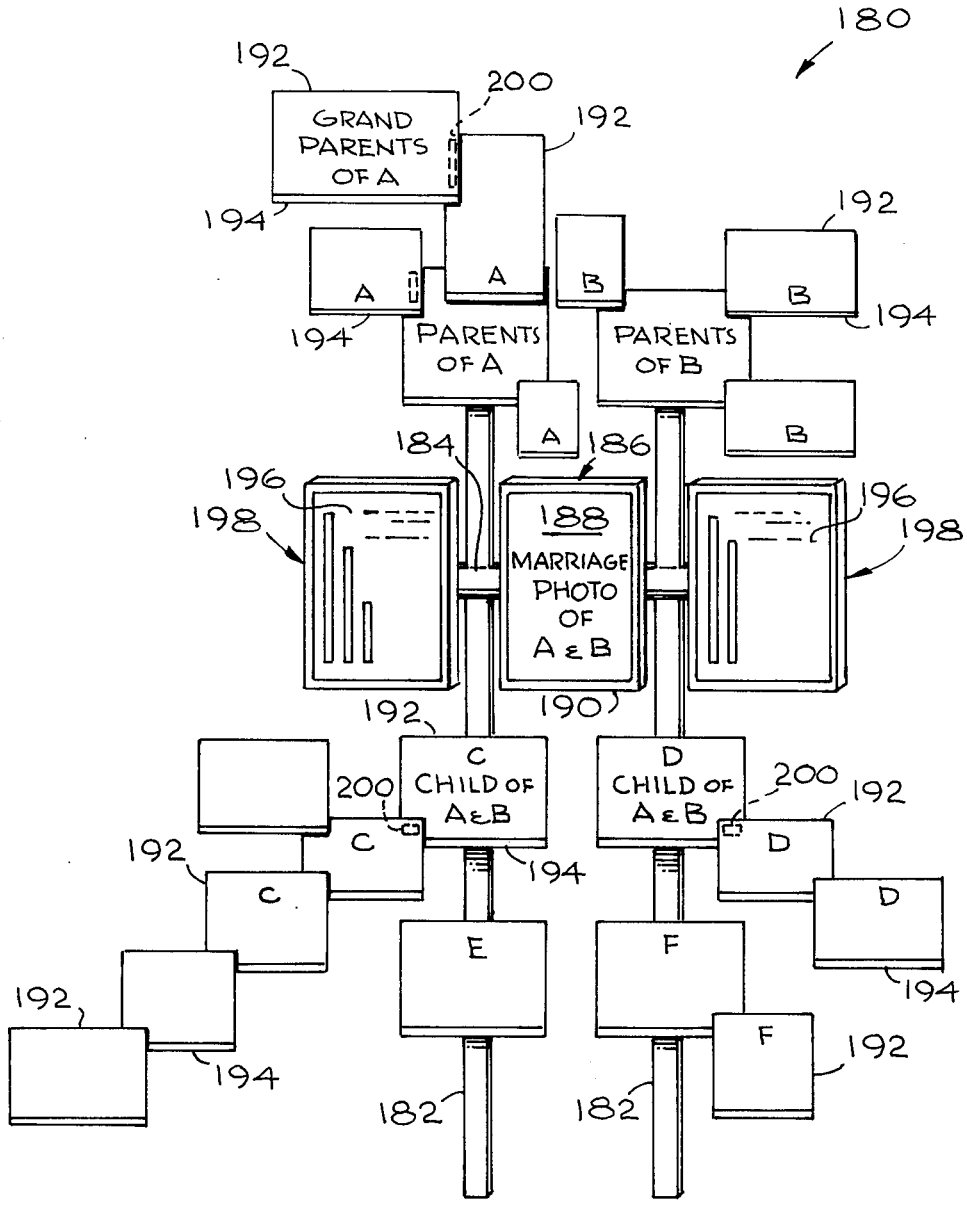
FIG. 9 is a schematic front elevation of a sixth preferred embodiment of the improved, decorative, three-dimensional display assembly of the present invention, in the form of a family geneology tree, with color coded display sheet margins and a lighted color coded log and central photo.
Figure 10:
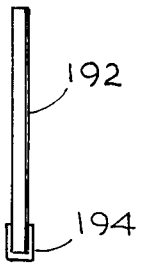
FIG. 10 is a schematic top plan view of one of the display sheets of the assembly of FIG. 9, depicting a color coded margin in place thereover.

FIGS. 9 and 10

A sixth embodiment of the improved decorative assembly of the invention is schematically depicted in FIGS. 9 and 10. Thus, an assembly 180 in the form of a geneological family tree is depicted in front elevation, and comprises a plurality of vertically extending spaced frame members 182 interconnected by a cross member 184.

On these members 182 are built up from a central core comprising a display sheet 186 bearing a photo 188 on its face, for example, a marriage photo which may be lighted by lighted support means 190, a plurality of successive levels of display sheets 192. Display sheets 192 are generally flat, self-supporting and of extended surface area and bear photos or other indicia on their faces.

Each level of sheets 192 represents a predetermined geneological reltionship to those depicted in photo 188. The individual sheets 192 are color coded, as by a distinctive colored margin tab 194 (FIG. 10) on each sheet 192, which color code is also displayed on the faces 196 of a pair of lighted color code logs 198 flanking sheet 186 and secured to frame members 182. The successive levels of sheets 192 are built up via spacer blocks 200 in the same manner as previously described for sheet level build ups in the first five embodiments described above.

As new family members are added to the family tree, they can be represented photographically by affixing their photos via new display sheets, etc. in the correct places in assembly 180 and correctly color coding and logging them to provide an up-to-date growing decorative family tree assembly.

FIGS. 11 through 16

Figure 11:
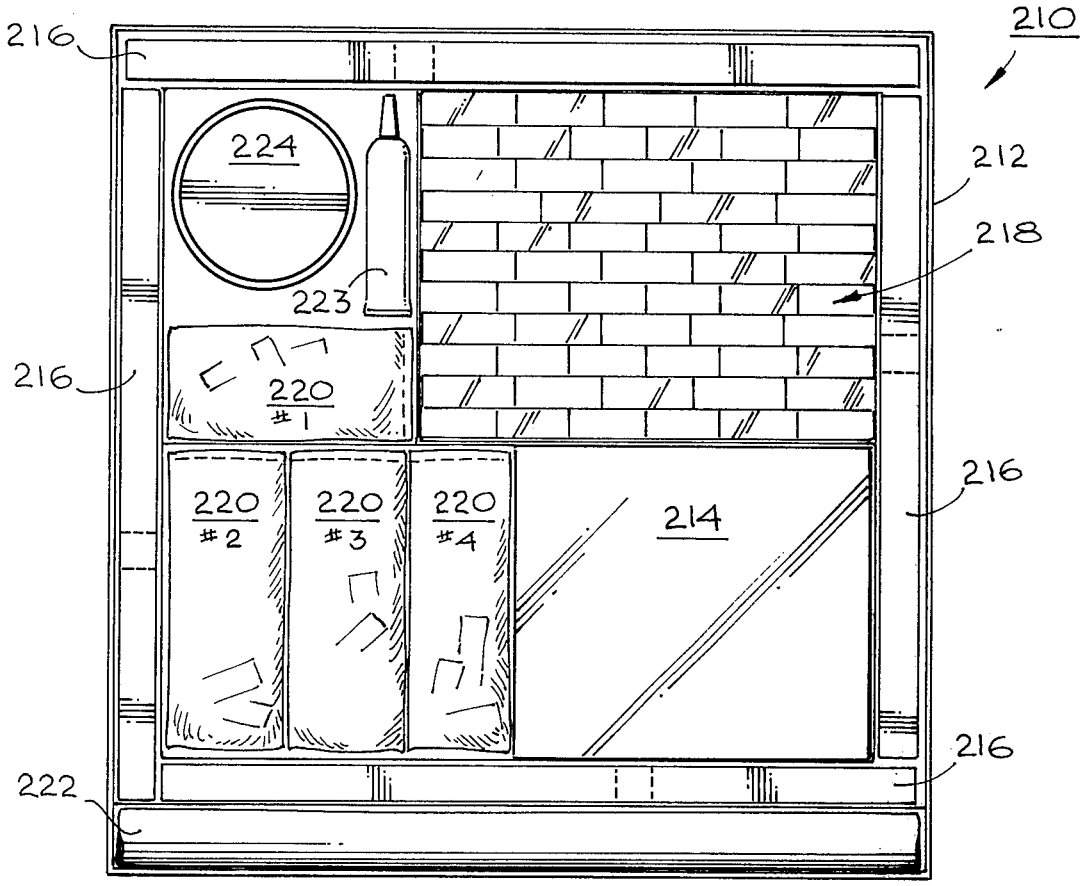
FIG. 11 is a schematic top plan view of a first preferred embodiment of a kit in accordance with the present invention for fabricating the improved display device of the present invention.
Figure 12:
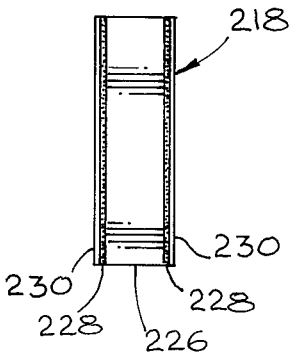
FIG. 12 is a schematic side elevation of a preferred embodiment of one of the spacers usable in the kit of FIG. 11.

A first preferred embodiment of the novel kit of the present invention for fabricating the improved three-dimensional decorative assembly of the present invention, is schematically depicted in FIGS. 11 and 12. Thus, a kit 210 is shown which is disposed in a box 212 and comprises a plurality of mounting boards 214 similar to, for example, boards 30 previously described.

It also includes a plurality of interconnectable frame pieces 216, a plurality of spacer blocks 218 of various lengths but uniform thickness, four separate packages of temporary supports 220 of wood or the like, a roll of four translucent paper patterns 222 depicting the proper layout for a plurality of levels or stages in the construction of a decorative assembly using kit 210, a tube 223 of white glue and a can 224 of clear liquid plastic coating.

The spacer blocks may be, for example, generally as shown in FIG. 12 and thus each may comprise a wood, plastic, carboard or the like core, a layer 228 of contact adhesive on two opposite long sides of block 218 and peelable protective paper strips 230 disposed over the adhesive layers 228.

In utilizing kit 210 in accordance with the method of the present invention, a plurality of, for example, photo prints are first selected for incorporation in the desired assembly and the photo prints are adhered to one face of mounting boards 214, as by glue 222.

The prints are then cut to conform to the size of boards 214 and, if desired, matching edges of the prints and boards are coated with decorative ink or the like.

Figure 13:
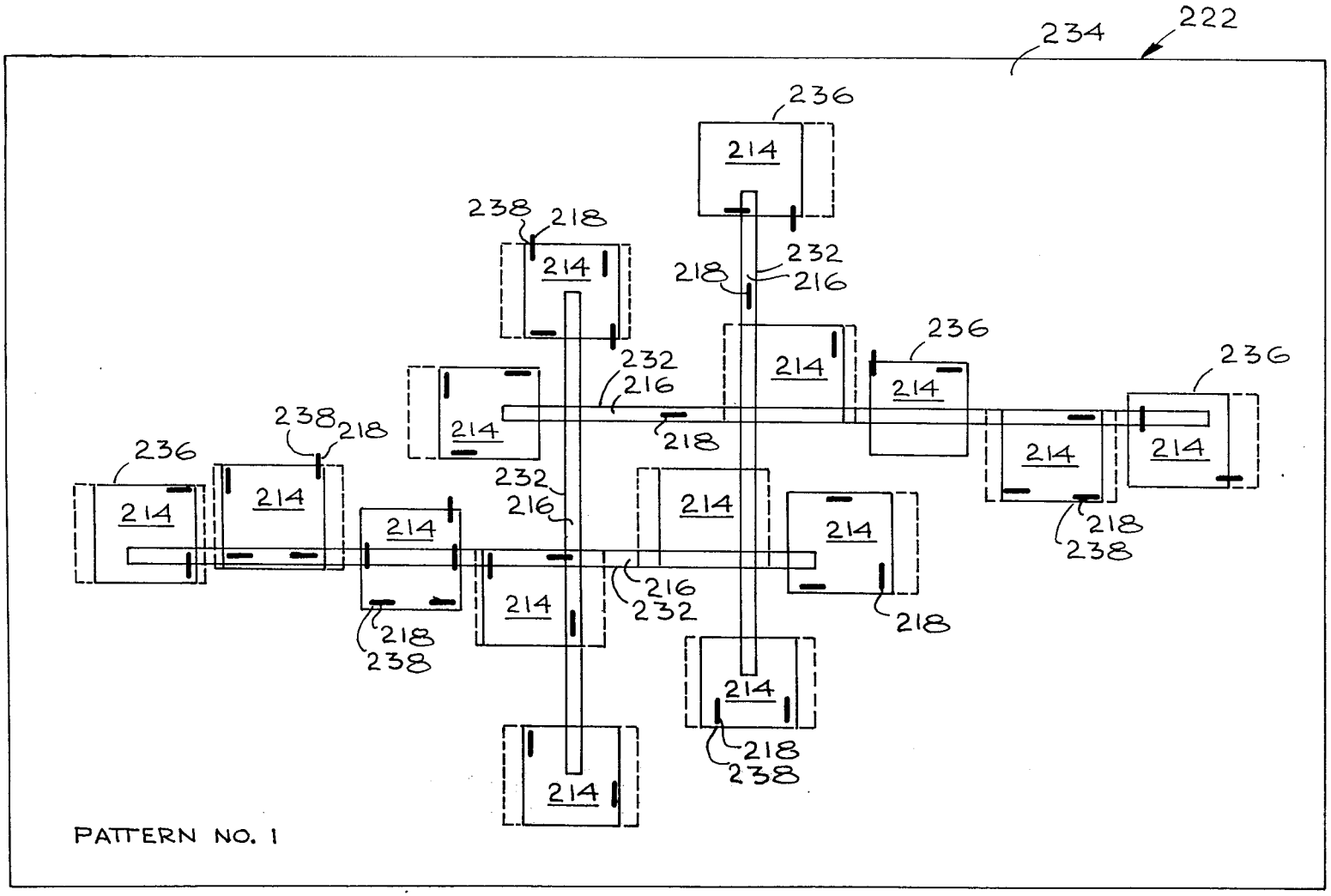
FIG. 13 is a schematic depiction of a first pattern sheet for the kit of FIG. 11 utilizable in constructing the improved decorative assembly of the present invention.

The pieces 216 are then fitted and glued together to form a frame according to and on top of the block lines 232 in pattern sheet 234 shown in FIG. 13 and the frame is then glued lightly in place to pattern sheet 234. Certain of the photos attached to boards 214 are then selected and glued in place by their boards 213 on the frame in accordance with the positions 236 indicated in sheet 234, and utilizing package number 1 of supports 220 to prop up boards 214 at the proper angle during the glue drying period. This forms a first structure level.

The wood spacer blocks 218 are then affixed on top of the photos in the positions 238 indicated in sheet 234, i.e., at the margins of the photos, as by peeling off paper strips 230 if the blocks are of the construction shown in FIG. 12.

Figure 14:
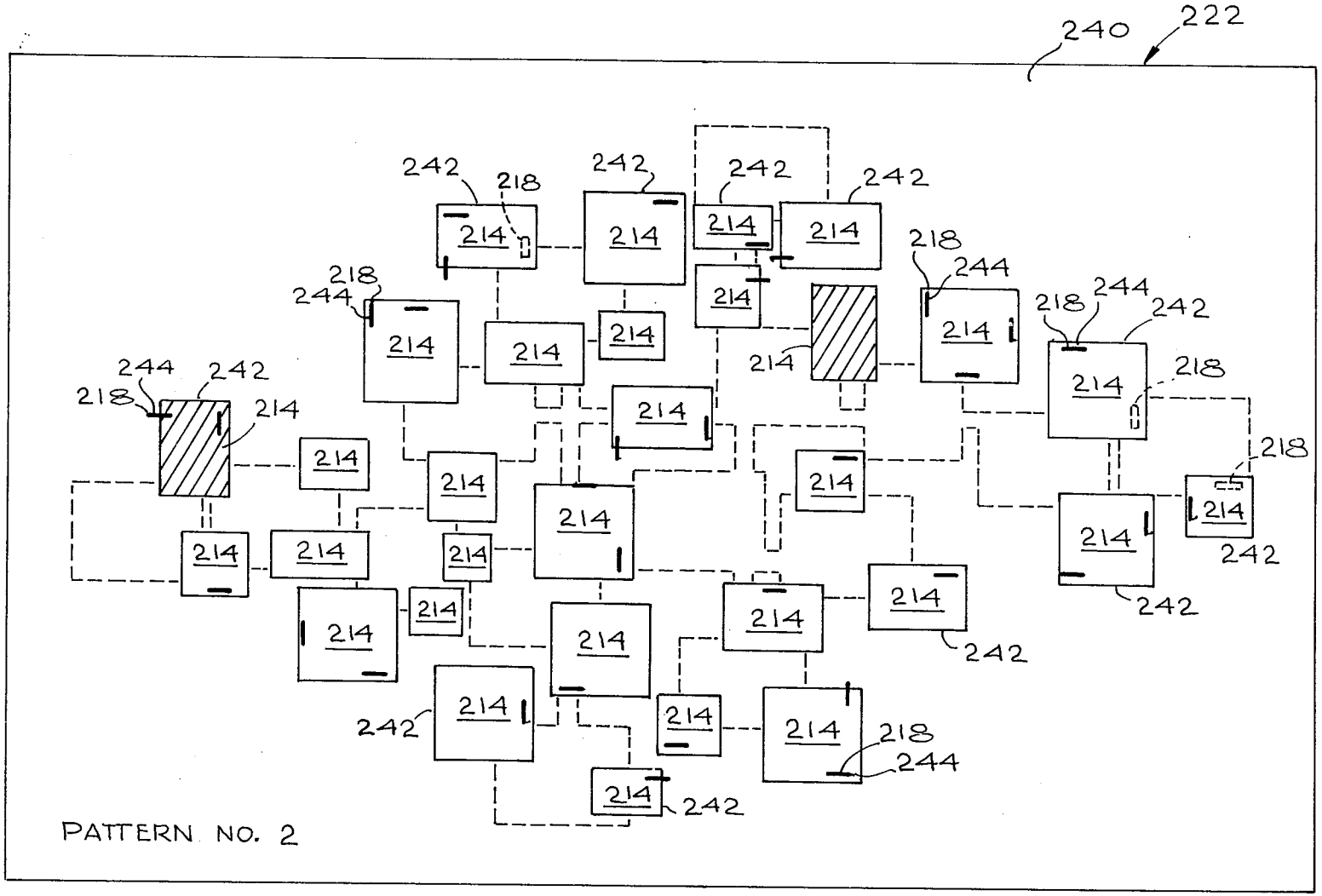
FIG. 14 is a schematic depiction of a second pattern sheet for the kit of FIG. 11.

The pattern 222 of FIG. 14, that is, sheet 240 is then substituted for sheet 234 under the frame. The frame is lightly attached to sheet 240, supports 220 from package number 1 are removed and additional photos are glued or otherwise affixed in place on the top of affixed spacer blocks 218 as per the positions 242 shown in sheet 240, supports 220 from package number 2 being used to prop the photos in place until the glue 223 dries. This forms a second structural level. Spacers 218 are then glued or adhesively connected in place on top of the photos of the second structural level, as per the positions 244 shown in sheet 240.

Figure 15:
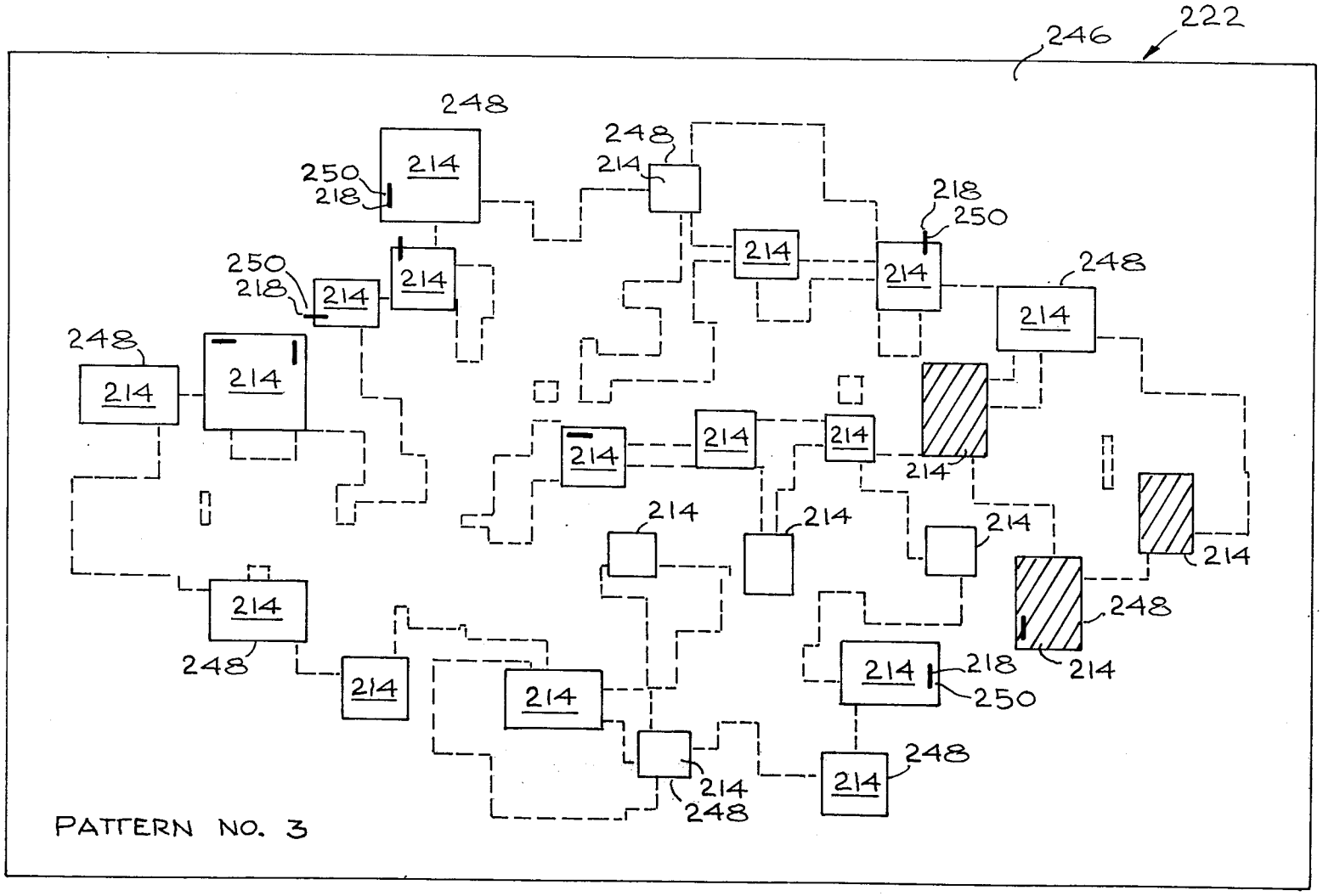
FIG. 15 is a schematic depiction of a third pattern sheet for the kit of FIG. 11.
Figure 16:
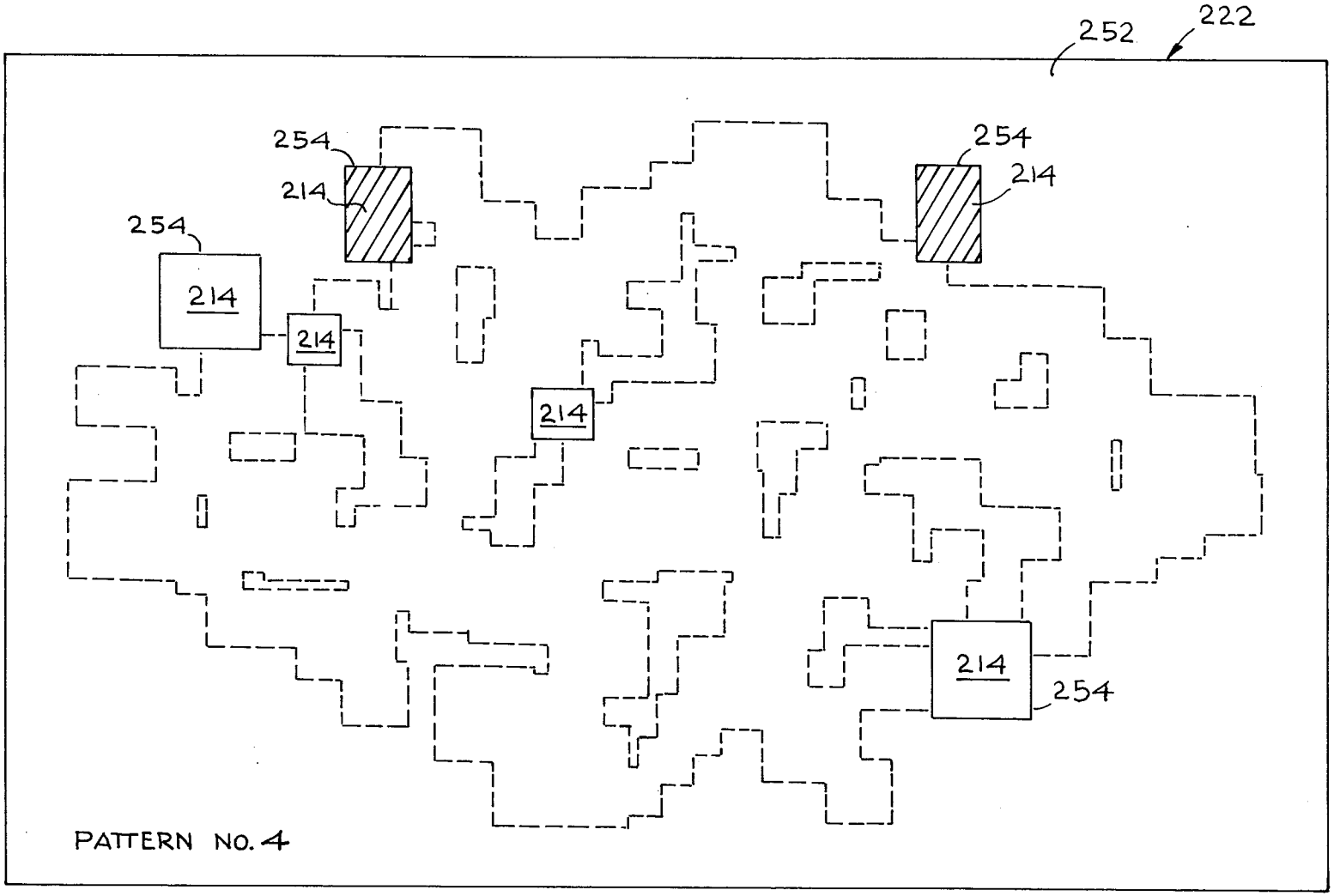
FIG. 16 is a schematic depiction of a fourth pattern sheet for the kit of FIG. 11; and, FIG. 17 is a schematic top plan view of a second preferred embodiment of the novel kit of the present invention, said kit including the box in which the remaining components are contained.

The pattern 222 of FIG. 15, that is, sheet 246, is then substituted for sheet 240 under the frame and the process is continued by gluing or otherwise affixing more photos in their positions 254, to form a fourth structural level using supports 220 from package number 4 to hold them in place until the glue is dry, and then removing supports 220.

It will be understood that in order to assure proper alignment of all components during fabrication of the assembly, one or more keys (not shown) can, if desired, be provided on sheets 240, 246 and 252, for example, phantom images in color, to show the position of one or more components previously positioned on the frame. Alternately, a single sheet with patterns for each desired level in different colors can be employed.

In accordance with the present method, the photos of the four structural levels can then, if desired, be protectively coated utilizing can 224 of clear liquid plastic. The plastic may be acrylic resin or the like, as previously described, settable, as by light, heat, air or the like to a clear hard finish.

The plastic is mixed and then smoothly coated on the photo surfaces, beginning with the lowermost level and working upwardly. Air bubbles are removed, as by gently blowing air across the unset coated surfaces, whereupon the assembly is covered, as by a box, to protect it from dust while the plastic is drying and setting. It is desirable to place the entire assembly on blocks, plastic cups or the like during the coating operation so that excess coating can freely drip therefrom.

It will be understood that any suitable clear coating can be used, if desired, in place of those described above. In any event, after setting of the coating, the finished three-dimensional sculpture is ready to mount on a wall, furniture top, etc., such item uniquely displays photos in a novel attractive permanent individualized manner as a fully distinctive decorative item.

FIG. 17

Figure 17:
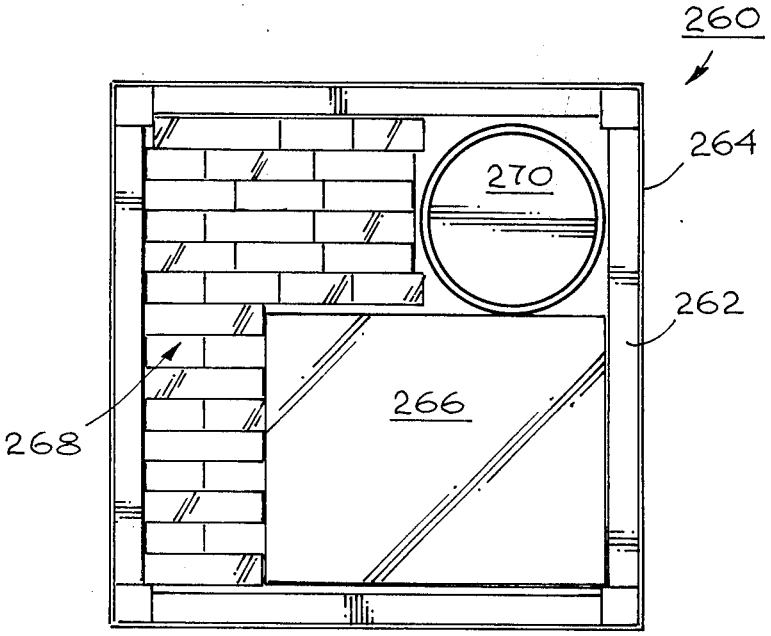

A simplified kit 260 is schematically shown in FIG. 17. Kit 260, like kit 210, is suitable for fabricating the improved decorative assembly of the invention according to the present method.

Kit 260 includes a frame 262 which comprises the sides, and in some instances the bottom, of a box 264, within which are disposed a stack of mounting boards 266 similar to boards 214, a stack of spacer blocks 268 which may be similar to blocks 218 and a can 270 of plastic coating.

Kit 260 is assembled, in accordance with the present method, in the same general manner as described above for kit 210, except that patterns and temporary supports are not used. Some of the mounting boards 266 may, moreover, be used to mount memorabilia but are attached to frame 262 and blocks 268 in the manner previously described, to provide an individualized assembly, the photos of which can be coated, if desired, with the protective coating in can 270.

Various modifications, changes, alterations and additions can be made in the present method, its steps and parameters, in the present kit, and assembly, their components and parameters. All such modifications, changes, alterations and additions as are within the scope of the appended claims form part of the present invention.

What is claimed is:

1. An improved kit for fabricating a decorative three-dimensional sculpture display assembly, said kit comprising, in combination:

a. frame means;

b. a plurality of stiff mounting boards adapted to receive display sheets;

c. a plurality of spacers for securing said boards and display sheets to one another and to said frame to provide a three-dimensional display assembly;

d. said frame means being comprised of a plurality of frame sections.

2. The improved kit of claim 1 wherein said frame means comprises the sides of a box within which said kit is disposed.

3. The improved kit of claim 2 wherein said frame means includes the bottom of said box.

4. An improved frameless photograph display assembly for presenting a plurality of photographs in a collage arrangement wherein a series of photographs are located in a plurality of parallel planes, with each photograph being laterally displaced in each respective plane while photographs in overlying planes partially overlie photographs in underlying planes, said assembly comprising:

a base member adapted to be mounted on a wall;

a plurality of frameless photograph mounting boards, at least one frameless photograph mounting board secured to and overlying said base member and lying in a first plane, and at least one frameless photograph mounting board lying in a second plane, said second plane being spaced a significant distance in front of said first plane, said photograph mounting board lying in said second plane having only a portion of its surface area overlying the photograph mounting board lying in said first plane, spacer means adapted to fixedly position said photograph mounting board lying in second plane with respect to said photograph lying in said first plane, one end of said spacer means being fixedly secured directly to the underside of said photograph mounting board lying in said second plane, a photograph secured to each of said mounting boards, said photograph overlying substantially all of the topside surface area of its associated mounting board, said mounting boards being so arranged as to define an opening extending from the front of said display assembly to said first plane.

5. The improved photograph display assembly of claim 4 wherein the wall can be seen through said opening.

6. The improved photograph display assembly of claim 4, including at least one mounting board and associated photograph lying in a third plane which is forwardly displaced a significant distance from said second plane by a second spacer means.

7. An improved frameless photograph display assembly for presenting a plurality of photographs in a collage arrangement wherein a series of photographs are located in a plurality of parallel planes, with each photograph being laterally displaced in each respective plane while photographs in overlying planes partially overlie photographs in underlying planes, said assembly comprising:

a base member adapted to be mounted on a wall, a plurality of frameless photograph mounting boards, at least one frameless photograph mounting board secured to and overlying said base member and lying in a first plane, and at least one frameless photograph mounting board lying in a second plane, said second plane being spaced a significant distance in front of said first plane, said photograph mounting board lying in said second plane having only a portion of its surface area overlying the photograph mounting board lying in said first plane, spacer means adapted to fixedly position said photograph mounting board lying in second plane with respect to said photograph lying in said first plane.

one end of said spacer means being fixedly secured directly to the underside of said photograph mounting board lying in said second plane, a photograph secured to each of said mounting boards, said photograph overlying substantially all of the topside surface area of its associated mounting board, wherein said base member and spacer means lie behind said mounting boards so as not to be visible from the front side of said display assembly, whereby said photographs appear to be spatially displaced and freely suspended in space, and wherein certain of said mounting boards are arranged so that portions of their parameters collectively define an opening.

8. The improved photograph display assembly of claim 7 wherein at least one photograph in said second plane only partially overlaps a plurality of photcgraphs in said first plane.

9. The improved photograph display assembly of claim 7 wherein said spacer means includes only a single spacer member which is secured to the underside marginal portion of each mounting board.

10. The improved photograph display assembly of claim 7 wherein said spacer means includes spacer members adapted to have one end thereof secured to the front-side marginal portion of a mounting board lying in a first plane and the other end thereof secured to the backside marginal portion of a mounting board lying in a second plane forwardly displaced from said first plane.

11. An improved decorative three-dimensional sculpture display assembly, said assembly comprising, in combination:

a. a support frame, b. a first series of self-supporting mounting boards of extended surface area bearing display sheets on only one main surface thereof;

c. said mounting boards being attached by their undersides to said frame at spaced intervals;

d. a second series of self-supporting mounting boards and associated display sheets similar to said first series;

e. a plurality of spacers connecting the marginal portions of said display sheets of said first series and the marginal portions of the underside of the mounting boards of said second series so as to interconnect individual sheets of said first and second series together in only partial overlapping relation to achieve a multi-level three-dimensional sculpture display assembly;

f. said support frame and spacers being located entirely behind said mounting boards;

g. whereby they are hidden from view when said sculpture display assembly is viewed from the front, and h. wherein certain of said mounting boards are arranged so that portions of their parameters collectively define an opening.

12. The display assembly of claim 11 wherein said mounting boards are so arranged as to define an opening extending from the front to the rear of said display assembly.

* * * * *

UNITED STATES PATENT OFFICE

CERTIFICATE OF CORRECTION

Patent No. 4,123,862 Dated November 7, 1978

Inventor(s) Shannon L. Dyer and Ronald L. Stangl

It is certified that error appears in the above-identified patent and that said Letters Patent are hereby corrected as shown below:

Claim 7, next to last line, "parameters" should be --perimeters--.

Claim 11 (h), next to last line, "parameters" should be --perimeters--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*